US006938771B2

(12) United States Patent
Friedrich et al.

(10) Patent No.: US 6,938,771 B2
(45) Date of Patent: Sep. 6, 2005

(54) FILM WRAPPED CONTAINERS AND PROCESSES FOR THE PRODUCTION AND MARKETING THEREOF

(75) Inventors: Richard Culver Friedrich, Powell, OH (US); Gregory T. Keferl, Worthington, OH (US)

(73) Assignee: OMS Investments, Inc., Los Angeles, CA (US)

( * ) Notice: Subject to any disclaimer, the term of this patent is extended or adjusted under 35 U.S.C. 154(b) by 105 days.

(21) Appl. No.: 10/327,415

(22) Filed: Dec. 20, 2002

(65) Prior Publication Data

US 2004/0118728 A1 Jun. 24, 2004

(51) Int. Cl.[7] ..... B65D 71/08
(52) U.S. Cl. ..... 206/497; 206/423; 206/459.5
(58) Field of Search ..... 206/423, 497, 206/459.5; 428/34.1, 34.9; 156/86, 217; 40/310

(56) References Cited

U.S. PATENT DOCUMENTS

| | | | | | |
|---|---|---|---|---|---|
| 3,927,484 | A | * | 12/1975 | Spiegel et al. | 40/307 |
| 3,976,795 | A | * | 8/1976 | Ando | 426/115 |
| 4,018,904 | A | * | 4/1977 | Muraoka | 426/115 |
| 4,025,378 | A | | 5/1977 | Amsden et al. | |
| 4,225,049 | A | * | 9/1980 | Inoue | 215/12.2 |
| 4,463,861 | A | | 8/1984 | Tsubone et al. | |
| 4,486,366 | A | | 12/1984 | Reddy | |
| 4,983,238 | A | | 1/1991 | Yoshida et al. | |
| 5,078,817 | A | | 1/1992 | Takagaki | |
| 5,154,448 | A | | 10/1992 | Griffin et al. | |
| 5,342,093 | A | | 8/1994 | Weernink | |
| 5,390,964 | A | * | 2/1995 | Gray, Jr. | 285/93 |
| 5,512,120 | A | | 4/1996 | Hinton et al. | |
| 5,512,352 | A | | 4/1996 | Haig | |
| 5,605,230 | A | * | 2/1997 | Marino et al. | 206/534 |
| 5,809,674 | A | | 9/1998 | Key | |
| 5,924,241 | A | | 7/1999 | Hodge | |
| 6,050,399 | A | * | 4/2000 | Pratt | 206/158 |
| 6,057,012 | A | * | 5/2000 | Culp et al. | 428/34.9 |
| 6,173,553 | B1 | | 1/2001 | Weder | |
| 6,230,441 | B1 | | 5/2001 | Weder et al. | |
| 6,231,958 | B1 | * | 5/2001 | Kim et al. | 528/272 |
| 6,253,488 | B1 | | 7/2001 | Murfin | |
| 6,325,879 | B1 | | 12/2001 | Heckman et al. | |
| 6,343,456 | B2 | | 2/2002 | Weder | |
| 6,375,771 | B1 | | 4/2002 | Bright | |
| 6,385,907 | B2 | | 5/2002 | Weder et al. | |
| 6,393,801 | B1 | | 5/2002 | Weder et al. | |
| 6,691,439 | B1 | * | 2/2004 | Miyashita et al. | 40/310 |
| 2003/0021918 | A1 | * | 1/2003 | McKillip | 428/34.1 |
| 2003/0134061 | A1 | * | 7/2003 | Benim et al. | 428/34.9 |
| 2003/0209459 | A1 | * | 11/2003 | Weder | 206/423 |

FOREIGN PATENT DOCUMENTS

| | | |
|---|---|---|
| GB | 2186213 | 8/1987 |

* cited by examiner

*Primary Examiner*—David T. Fidei
(74) *Attorney, Agent, or Firm*—Jones Day

(57) ABSTRACT

A film wrapped container is disclosed including a container having no human-readable visible display markings thereon; and a heat shrinkable PVC or PETG film wrapping having human-readable display markings thereon is heat shrunk on the container in a manner such that the heat shrunk film wrapping is fixedly attached to the container without applying any adhesive and is removable, if desired, to reveal the container with no information about the product recognizable to a human. Additionally, a process for producing such a film wrapped container and a process for marketing the container are provided.

7 Claims, 3 Drawing Sheets

FILM WRAPPED CONTAINERS AND PROCESSES FOR THE PRODUCTION AND MARKETING THEREOF

BACKGROUND OF THE INVENTION

1. Field of the Invention

This invention relates to film wrapped containers such as flower pots and processes for producing and marketing such containers. More particularly, it relates to products produced by applying printed heat-shrinkable PVC or PETG film wrappings over containers having no human-readable visible display markings thereon and, at most, having only machine-readable visible markings such as bar code symbols imprinted thereon so that the heat shrinkable film wrappings can be readily removed, if desired, to reveal the containers which either have no human-readable visible display markings thereon or, if the containers have any markings thereon, the visible markings are only machine-readable.

2. Description of the Related Art

In displaying and selling packaged goods, it is generally important to apply visible markings such as product identifiers, instructional material, corporate logos, trademarks and the like to the visible portions of a container for commercial purposes such as sales promotion of the goods packaged in the container. Heretofore, such visible markings have generally been applied directly to the visible portions of a container by various techniques including printing, embossing, etching and the like either directly onto the side walls of the container or by attaching to the container a film or wrapper having the visible markings thereon.

The direct application method has been known in the prior art to exhibit numerous disadvantages. For example, U.S. Pat. No. 5,078,817 describes the extreme difficulty of printing high quality multi-color visible markings on an often irregularly shaped container surface. Furthermore, it has been recognized heretofore that applying a pre-printed label to a container allows for higher quality printing and more sophisticated color schemes to be utilized.

Heretofore, various types of printed films and methods for labeling packaged goods have been used throughout the packaging industry. For example, U.S. Pat. No. 5,512,120 discloses a method for applying a heat-shrinkable film to a container such as a beverage can. U.S. Pat. No. 6,375,771 discloses a method of applying an elastic label to a container by stretching the label around the container. U.S. Pat. No. 6,325,879 discloses a method for applying a label to an irregularly shaped and curved container. U.S. Pat. No. 5,078,817 discloses a label to be used on a food container that will not detach from the container when subjected to heat sterilization. U.S. Pat. No. 5,512,352 discloses a method of applying a heat-shrinkable label to an object with a small diameter, such as a battery. U.K. Patent No. 2,186,213 discloses a general heat-shrinkable label with attached heat-activated adhesive that helps keep the label attached to the container.

The labels that these patents disclose provide users in the industry with a wide variety of options to use for various labeling applications. However, none of these patents disclose a label that can be easily removed from the container after it has been attached. All of these patents incorporate some type of label attaching means that prevent the labels from being removed.

Most of the prior patents require the use of an adhesive to adhere the label to the container. Other patents, such as U.S. Pat. No. 5,078,817 require the use of melt-bonding to adhere the label to the container. U.S. Pat. No. 4,025,378 requires a label to be welded to a container by applying heat to the label. The permanent nature of the label attachment in these patents is disadvantageous to users who desire to remove the label from the container.

Other patents disclose the use of labels constructed from foamed polystyrene material. U.S. Pat. No. 4,463,861 discloses labels constructed partially of polystyrene that are applied to glass containers to help prevent breakage. U.S. Pat. No. 4,486,366 discloses a method of producing foamed polystyrene labels that can be stored without undergoing shrinkage at ambient temperature. U.S. Pat. No. 4,983,238 discloses a label constructed from foamed polystyrene which is used to insulate the temperature of the inside container from the outside environment.

Foamed polystyrene labels are heat-shrunk onto containers and do not require the use of adhesives. These labels can also contain printed material. However, the heat-shrunk labels cannot be readily removed from the underlying container surface. Furthermore, although the foamed polystyrene labels disclosed in these patents are useful for some labeling applications, the polystyrene label provides a poor surface on which to print visible markings. During the heat-shrinking process, the printed visible markings on the label can become distorted by streaks and creases that form in the polystyrene material. Thus, the use of polystyrene labels is limited to applications with very basic printing requirements. This limitation on print quality is disadvantageous to a user that requires or desires a sophisticated print design. U.S. Pat. No. 4,486,366 discloses other disadvantages of constructing labels from foamed polystyrene, such as the material's brittleness and the foam's susceptibility to tearing and fracturing.

Other U.S. patents disclose labels that have flexibility in the amount and type of printed visible markings that is visible. U.S. Pat. No. 5,342,093 discloses a label that has a double layer to provide increased surface area to apply printed material. U.S. Pat. No. 5,809,674 discloses a label that can be rotated to expose different types of visible markings printed on the container below the rotating label. U.S. Pat. No. 5,154,448 discloses a label that can be scratched off to reveal a contrasting color below. All of the products described in these patents, however, exhibit disadvantages.

Although the labels disclosed in U.S. Pat. No. 5,342,093 are partially removable, the bottom-most layer of the label is adhered to the container and is not removable. Likewise, although the labels disclosed in U.S. Pat. No. 5,809,674 can be removed completely, the container itself contains non-removable printed visible display markings which convey information about the product to a human customer. A user cannot completely remove either of these labels to reveal a neutral container having no visible markings or only machine-readable visible markings such as bar codes. The scratch-off label disclosed in U.S. Pat. No. 5,154,448 does not contain any printed visible markings itself, but rather must be scratched off to create the printed visible markings. Thus, this label is not useful to a user desiring to have removable printed label.

In addition to the labels disclosed in the previously identified patents, certain prior art patents have disclosed various covers to be placed around plant pots. These products all present a variety of problems and disadvantages.

For example, the invention disclosed in U.S. Pat. No. 6,253,488, discloses a double pot with a transparent inner pot and an opaque outer pot. No printing is present on the outer pot, and the outer pot cannot be removed for long periods because the root system will be damaged by sunlight penetrating the transparent inner pot. U.S. Pat. No. 6,343,456 discloses a plant cover constructed of a heat shrinkable material. However, unlike the present invention, this plant cover is bonded to the container by forming a crimp in the plant cover. This crimping secures the cover to the container and prevents convenient removal of the cover from the underlying container.

Other plant pot covers disclosed in the prior art are merely decorative in nature. U.S. Pat. No. 5,924,241 discloses a decorative cover made from fabric and attached to the pot with elastic strips or "Velcro" attachments. U.S. Pat. Nos. 6,393,801; 6,385,907; 6,230,441 and 6,173,553 disclose various decorative sleeves that can be placed around a plant pot to protect the plant during transport. None of these patents use heat-shrinkable material in the construction of the pot plant covers. None disclose printing visible display markings on the covers. Plant covers constructed from shrink-wrapped material are more advantageous than plant covers constructed from cloth and "Velcro."

From a commercial perspective, applying printed labels on the sides of containers has reduced the flexibility a distributor of containers has to market products. That is, once a label has been attached to a container, the label gives the product an identity in the consumer marketplace, and once this identity has attached to the product the seller must sell the product bearing this specific identity to a consumer.

Although labels printed on separately attached films allow sellers more flexibility than labels printed on the side-wall of containers, the inability to change the identity of the product created by the visible markings on a container is a substantial disadvantage of the packaging systems known in the prior art. A seller with the ability to remove and replace product packaging labels without changing or damaging the product would have a considerable advantage over other sellers who cannot alter the appearance of a product after a label has been attached.

A removable label allows a seller to alter the appearance of a product to reflect the ever-changing tastes of the buying public. Product labels can be changed to reflect seasonal and holiday promotions throughout the year while the product being sold remains unchanged. Product labels can also contain film and television merchandising tie-ins, and label changes can be synchronized with corresponding theatrical, television or album release dates.

Removable labels are also especially useful in the sale of damageable or perishable goods. Sellers of such goods face a dilemma when the quality of these goods falls below the standards associated with the brand-name or logo. For example, perishable goods typically have an expiration date, after which the freshness and quality of the consumable is not guaranteed. After goods have expired, sellers have few options to dispose of the goods. Selling the expired goods at a discount will hurt the reputation of the brand-name, trademark or logo, because the expired goods are of a lower quality than goods usually sold under the identifying mark. In this situation, a seller must either incur a large monetary loss and not sell the inferior goods, or sell the inferior goods at a discount and risk diminishing the reputation of the brand-name, trademark or logo.

Perishable goods are not limited to consumable products, but include products such as plants, flowers, film, batteries, household chemicals and industrial chemicals. A system whereby all identifying marks that can be read and understood by a human customer are removed would be extremely useful for any product that has the potential to lose quality as time passes.

Accordingly, it is an object of the present invention to overcome the above-described disadvantages of the prior-art and to provide efficient, cost effective containers having heat-shrinkable film wrappings or labels applied thereto.

A further object of this invention is to provide a process for producing such containers having heat-shrinkable film wrappings or labels applied thereto.

A still further significant object of the present invention is to provide a process for marketing the containers having heat-shrinkable film wrappings or labels applied thereto in a new and improved, cost effective manner.

BRIEF SUMMARY OF THE INVENTION

The present invention overcomes disadvantages in the prior art by providing a container having a printed film wrapping or label applied thereon that can be removed without altering the underlying product. The underlying container is constructed from any suitable material such as a thermoplastic resin which may be molded in any desired color including neutral shades, white or any other color. In this invention, the container has no human-readable visible display markings imprinted thereon but may, optionally, have machine-readable visible display markings thereon such as bar code symbols and the like.

As used herein the term "human-readable visible display markings" refers to markings appearing on a surface of a product which conveys information about the origin, quality, pricing, inventory, composition and like qualities of the product to a human who views the visible markings. The term "machine-readable visible display markings" refers to visible markings appearing on a surface of a product which also convey information about the origin, quality, pricing, inventory, composition and like qualities of the product but can be understood only by a machine.

Visible markings such as bar codes or other coded markings are not human-readable because no information about the origin, quality, pricing, inventory or composition of the product is conveyed to a human who views the coded visible markings. Such visible markings are considered to be machine-readable because only a machine can obtain information about the product by viewing or scanning the coded visible markings.

A bar code is the small image of lines (bars) and spaces that is affixed to retail store items, identification cards, and postal mail to identify a particular product number, person, or location. The code uses a sequence of vertical bars and spaces to represent numbers and other symbols. A bar code symbol typically consists of five parts: a quiet zone, a start character, data characters (including an optional check character), a stop character, and another quiet zone.

A machine known as a barcode reader is used to read the code. The reader uses a laser beam that is sensitive to the reflections from the line and space thickness and variation. The reader translates the reflected light into digital data that is transferred to a computer for immediate action or storage. Bar codes and readers are most often seen in supermarkets and retail stores, but a large number of different uses have been found for them. They are also used to take inventory in retail stores; to check out books from a library; to track manufacturing and shipping movement; to sign in on a job; to identify hospital patients; and to tabulate the results of direct mail marketing returns. Very small bar codes have been used to tag honey bees used in research. Readers may be attached to a computer (as they often are in retail store settings) or separate and portable, in which case they store the data they read until it can be fed into a computer.

There is no one standard bar code; instead, there are several different bar code standards called symbologies that serve different uses, industries, or geographic needs. Since 1973 the Uniform Product Code (UPC), regulated by the Uniform Code Council, an industry organization, has provided a standard bar code used by most retail stores. The European Article Numbering system (EAN), developed by Joe Woodland, the inventor of the first bar code system, allows for an extra pair of digits and is becoming widely used. POSTNET is the standard bar code used in the United States for Zip codes in bulk mailing.

In accordance with the present invention, a heat-shrinkable polyvinyl chloride ("PVC") or polyethylene terephthalate, glycol modified ("PETG") polymer is employed as the film wrapping or label material. Such PVC and PETG film wrapping is adapted for multi-color printing on its inner side. In accordance with this invention, the PVC or PETG film is provided in any suitable shape to enable it to be wrapped effectively on an underlying container. Containers or pots employed in accordance with this invention for growing plants are normally formed in the shape of cylinders, squares, rectangles, frusto-conic sections and the like having upstanding walls extending from solid planar bases and may be of any color desired although neutral shades are preferred. The film wrappings are provided in corresponding shapes configured and sized to accommodate the container for shrink wrapping.

For example, in accordance with this invention, when a standard hollow cylindrical container or pot having no human-readable visible display markings and only machine-readable visible markings thereon is to be wrapped, the film is provided in a cylinder having a circumference slightly larger than the circumference of the underlying container prior to heat shrink attachment to the underlying container. Furthermore, after application on the container, the film wrapping is heat shrunk on the surface of the container and is fixedly attached to the container without applying any adhesive.

The heat shrunk wrapping is applied on the container in a manner such that the film wrapping having human-readable visible display markings thereon available for identifying the purveyor of the container or for providing instructional or informative data and the like relative to the product in the container. Significantly, the heat shrunk wrapping can be readily removed from engagement with the container to reveal the container below with no human-readable display markings thereon so that the source and/or identity of the purveyor of the now visible container or any other such informative data cannot be determined from the markings thereon. The only identification that is provided on the container having the heat shrunk wrapper removed therefrom are the machine-readable markings that may optionally have been provided on a surface of the container prior to wrapping.

In the present invention, heat-shrinkable film wrappers such as PVC or PETG polymers are attached to containers as a label or the like. The film wrappers contain any visible human-readable and machine-readable display markings that the purveyor or seller desires to use in marketing the product. The display markings may be printed on the film and can contain multi-color logos, instructions, ingredients and any other figures or information used to identify and describe the product. Furthermore, the film may include such machine-readable markings as bar codes for pricing and inventory control purposes.

The underlying container may include no identifying markings so that it alone will provide a human viewer with no information as to the origin of the product. Printing, such as bar codes or other coded markings, that do not provide human-readable information about the origin, quality, composition or similar characteristics of the product optionally may appear on the underlying container, as desired. In this regard, it should be noted that any machine-readable display markings such as bar codes which appear on the surface of a container will not be readable through the PVC or PETG polymeric film wrapping applied on the container so that there will be no confusion of machine derived information (eg, from a barcode reader) from the markings on the container as compared with information on the film wrapping, as long as the wrapping remains intact over the container.

In marketing these container products, the printed film is initially attached to the container by heat-shrinking without any adhesive bonding and the visible display markings appearing on the film are prominently exhibited to consumers. If, however, the so labeled and marked product is not sold, the film wrapping can be readily removed and the container can be further offered for sale as a generic product without influencing the goodwill of the initial seller.

More particularly, limiting the human-readable visible markings to only the heat-shrinkable film and not to the container and eliminating the use of adhesive to attach the label to the container allows the label to be easily removed to reveal a generic container. Accordingly, the label can be removed by cutting or tearing the upper or lower area of the film, and tearing the remaining portion from the container. The containers can be re-labeled if the product contained therein can accommodate the re-labeling process, or the container can be hand labeled with a pen or marker if the container is resistant to re-labeling. The container can also be marketed without any information on the label, but rather with the marketing information on separate signage at the point of sale. These containers without printed labels are ideal for selling discounted products without diluting the good-will of a brand-name or logo, or for removing from the product a specific marketing scheme that has become unpopular or outdated. These containers provide merchants with a flexible method of marketing goods to the public.

Accordingly, in a preferred embodiment of this invention a process for marketing a container for growing plants is provided wherein a container is supplied having a heat shrinkable PVC or PETG polymer film wrapping heat shrunk thereon. The film wrapping has printed visible display markings thereon and the container has no human-readable visible display markings thereon. The heat-shrunk film wrapping is fixedly attached to the container without applying any adhesive and is removable from the container. The container having the heat shrunk film wrapping thereon which exhibits the visible markings appearing on the wrapping is then displayed for sale to consumers of the product. However, if the product is not sold, the film wrapping may, optionally, be removed from the container to prevent detection of the visible markings appearing on the wrapping and to reveal only the surface of the container which has no human-readable visible display markings thereon so that the container with the wrapping removed can be sold as a generic product without the human-readable data including any brand-name, trademark or logo or other such identifying data which appeared on the wrapping.

In accordance with the foregoing, it should be noted that the container may be blank and have no visible display markings whatsoever appearing thereon. However, for purposes of inventory control, pricing and the like, sellers of these products may find it highly advantageous to provide machine-readable markings, especially bar codes, on the surface of the container. Of course, these machine readable markings will not alter the generic nature of the container with the heat shrunk wrapping removed therefrom since no human-readable visible display markings will appear thereon. Furthermore, it should be noted that in view of the heat shrinkable PVC or PETG film wrapping initially attached over the container, any machine-readable markings appearing on the container surface will not be available to be read by any such machine such as a bar code reader until the wrapping is removed from the surface of the container.

In a further embodiment of the present invention, a film wrapped container is provided wherein the container has no human-readable visible display markings thereon, although it may have machine-readable display markings such as bar codes thereon. A heat shrinkable film wrapping is heat shrunk on the container in a manner such that the heat-shrunk film wrapping is fixedly attached to the container without applying any adhesive and is removable, if desired, to reveal the container with no human-readable visible display markings thereon. The heat shrinkable film may be a polyvinyl chloride or a polyethylene terephthalate, glycol modified polymer.

In another embodiment, the present invention provides a process for producing the film wrapped containers disclosed herein. The process comprises providing a container having no human-readable visible display markings and applying a heat shrinkable film wrapping over the container by heat shrinking the film wrapping on the container in a manner such that the heat-shrunk film wrapping is fixedly attached to the container without applying any adhesive and can be removed, if desired, to reveal the container with no visible markings or only machine-readable visible markings printed thereon. The heat shrinkable film is selected from the group consisting of polyvinyl chloride and polyethylene terephthalate, glycol modified polymers.

BRIEF DESCRIPTION OF THE SEVERAL VIEWS OF THE DRAWING(S)

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF A PREFERRED EMBODIMENT OF THE INVENTION

Figure 1:
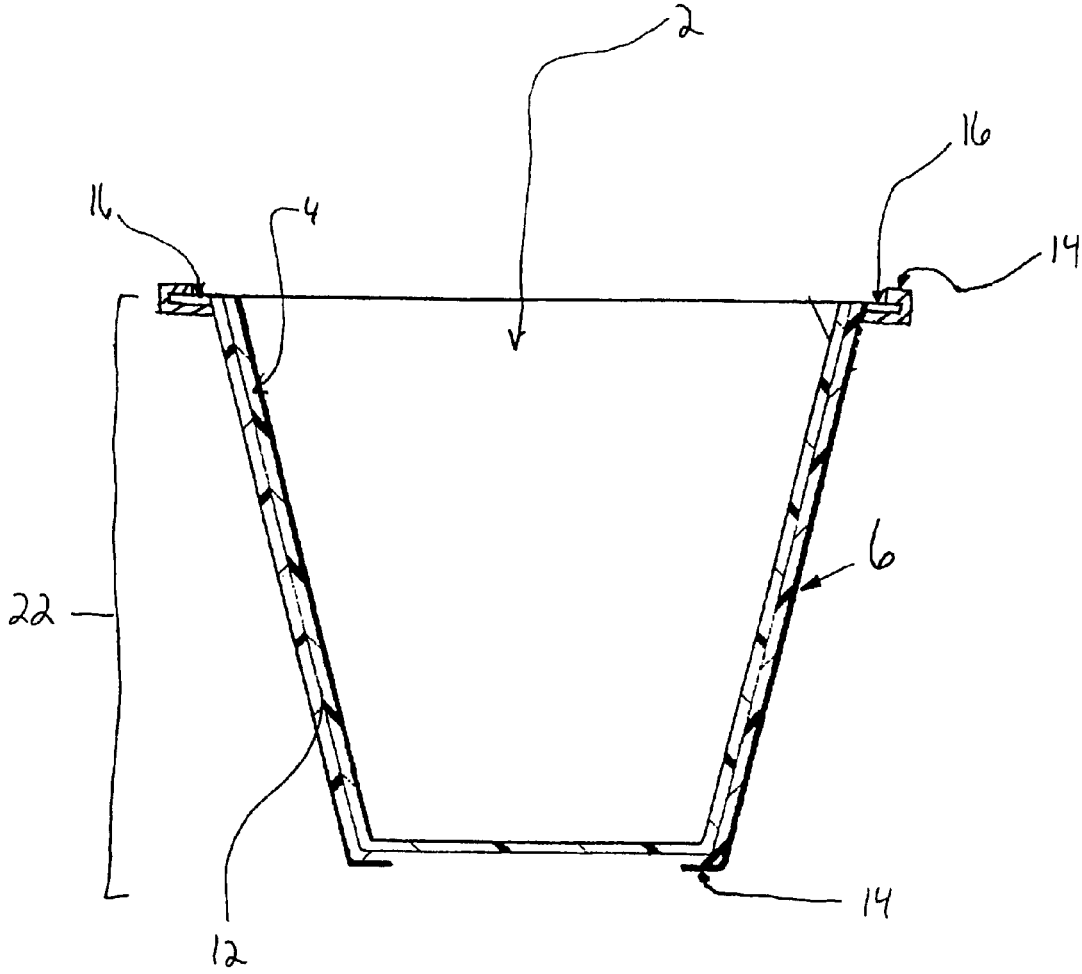
FIG. 1 is a longitudinal sectional view of a film wrapped container according to the present invention including an underlying container having no human-readable visible markings imprinted thereon and a printed heat shrinkable PVC or, PETG film wrapping or label applied over the generic container.
Figure 2:
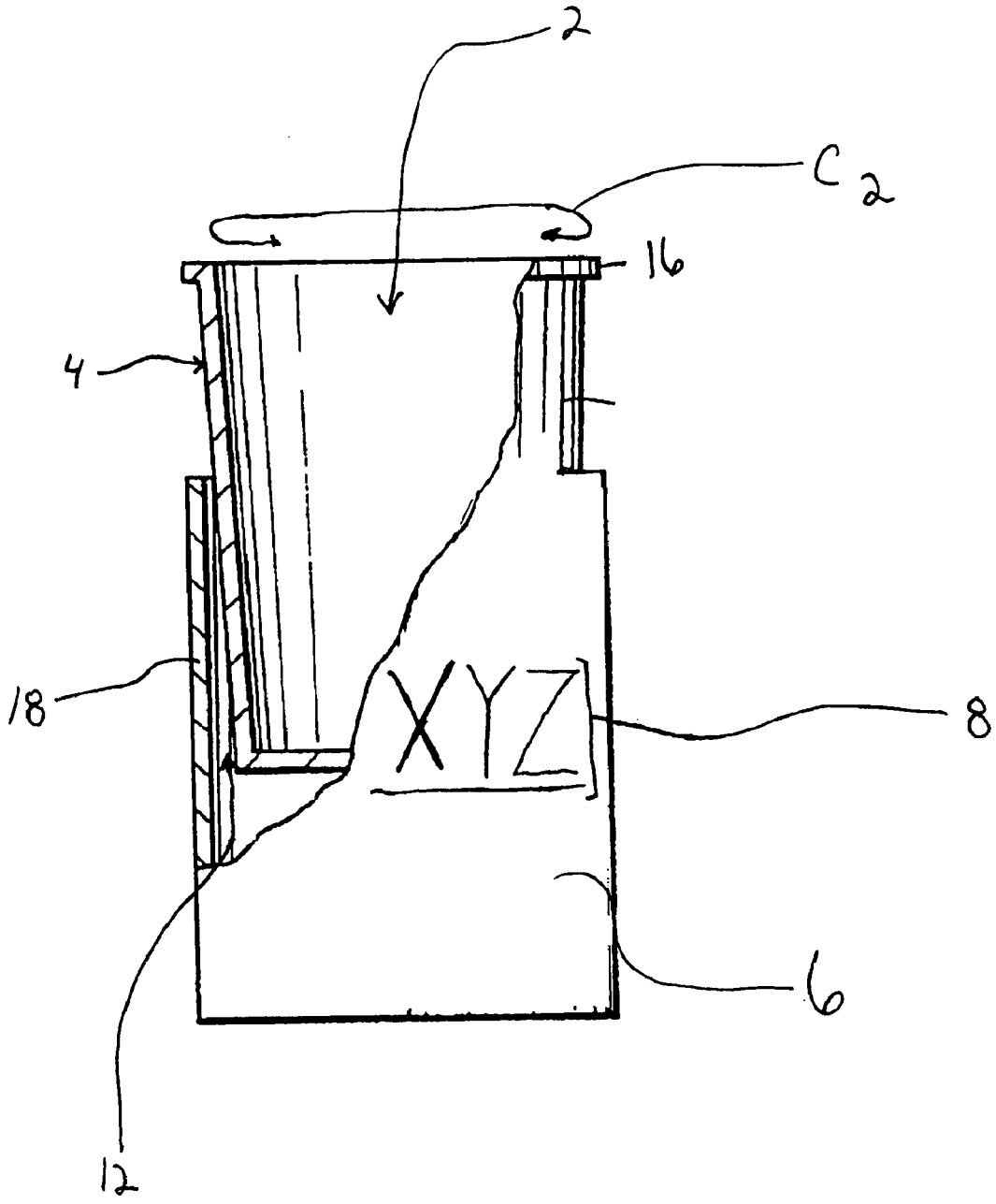
FIG. 2 is a schematic view illustrating a process of covering a container with a cylindrical printed heat shrinkable PVC or PETG film wrapping or label prior to heat shrink attachment to the container.
Figure 3:
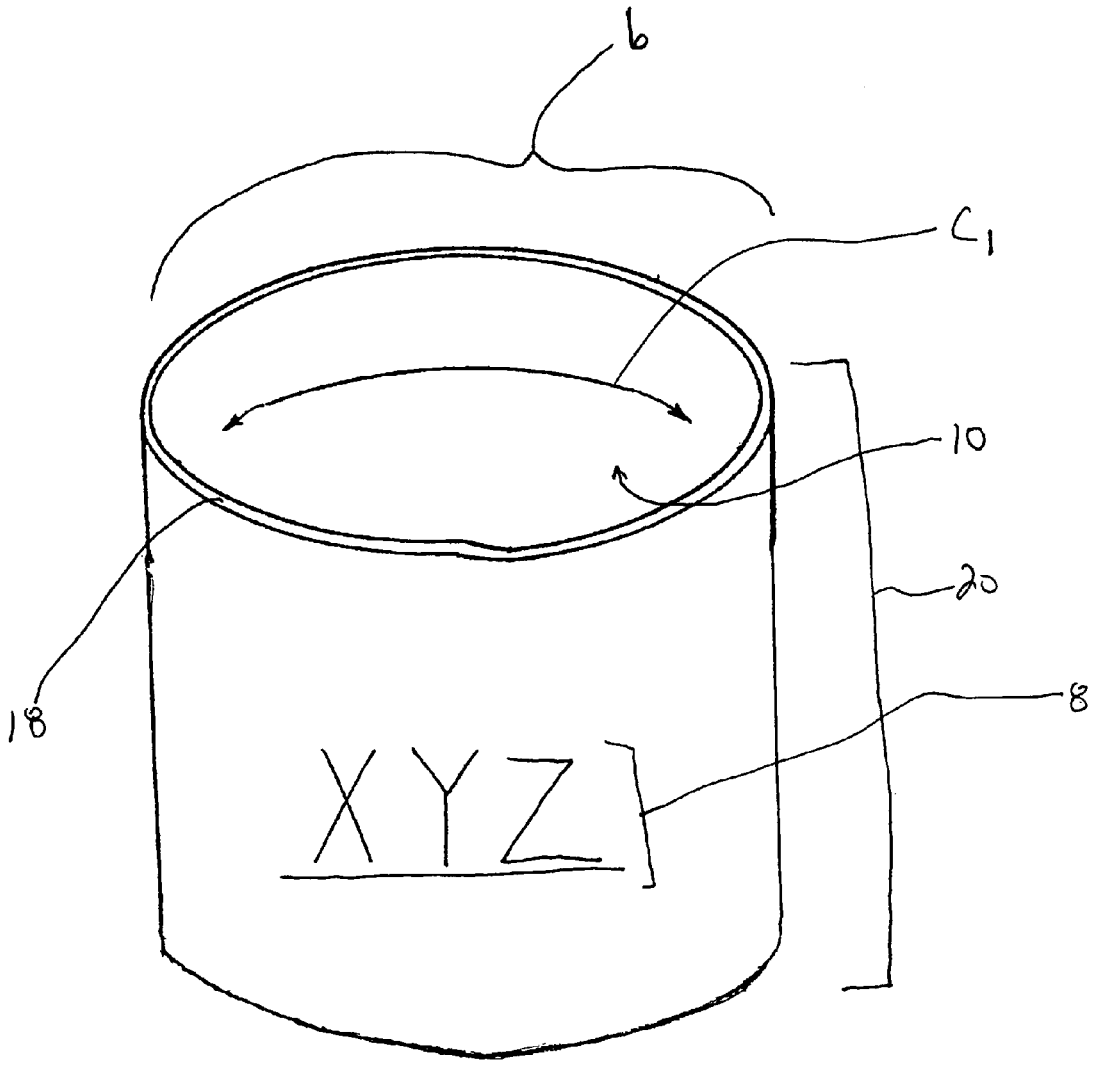
FIG. 3 shows a cylindrical printed heat shrinkable PVC or PETG film wrapping or label prior to heat shrink attachment to a container.

Reference is now made to the figures wherein like parts are referred to by like numerals throughout. A neutral container 2 having only a bar code symbol or other machine-readable coded markings imprinted thereon is formed from any appropriate material, preferably a thermoplastic resin. The container 2 main body side or its outermost layer 4 is, preferably, made of the same resin as constituting a heat-shrinkable film 6 which is fixedly attached thereto by heat shrinking. Because the container 2 must withstand the heat shrinkage treatment for the heat-shrinkable film 6, at least the outermost layer 4 of the container 2 main body must consist of a heat resistant layer having a heat deformation temperature of about 80° C. or higher.

The heat-shrinkable film 6 used in the process of the present invention, preferably, has visible human-readable display markings 8 imprinted on its inner side 10, and the film 6 is fixed to the side of the container main body 2 so that the printed inner side 10 of the film 6 faces the outermost layer 4 of the container 2 main body. The fixing of the film 6 in such a manner (i.e. the non-printed side of the film is not fixed and is exposed to the air) is preferable, because it protects the stability of the print from the outside environment.

The heat-shrinkable film 6 having a print at the inner side 10 is transparent and has surface gloss and accordingly can have a high commercial value. Printing of the film 6 at the inner side 10 can be accomplished by rotogravure reverse printing, offset printing, and other printing methods known in the industry. A preferred printing process of the present invention uses up to ten different colors of ultra-violet fixed inks to provide a sophisticated and highly attractive design.

The heat-shrinkable film 6 is attached to the container 2 with no adhesive and remains attached to the container due to the surface-area contact created when the film 6 is heat-shrunk to the container 2. A slight film 6 overlap 14 above and below the container 2 assists in keeping the film 6 firmly attached to the container 2. Further, in order to prevent shift of the label during heat shrinkage and to reduce the likelihood of mold and bacteria growth in the area between 12 the container outermost layer 4 and the label film 6, it is recommended to use a container that has a flange 16 at an open end.

The heat-shrinkable film 6 is constructed from PVC or PETG material with a thickness 18 of between about 40 and about 70 microns, preferably between about 50 and about 60 microns. Because adhesive is not used to attach the heat-shrinkable film 6 to the container 2, a film 6 with a thickness 18 of less than about 50 microns will be difficult to attach to the container 2. A film 6 with a thickness 18 of less than about 50 microns that is attached to a container 2 by heat-shrinking alone will slip partially or completely from the container 2. Thus, the PVC or PETG label should preferably be thicker than about 50 microns, and must be thicker than about 40 microns to function properly in this invention.

A film 6 with a thickness 18 of greater than 60 microns will function adequately in the application disclosed in this invention. However, a film 6 thicker than about 60 microns creates no advantages in the current invention, and the film 6 becomes increasingly expensive to produce as the thickness 18 of the film increases. Although a film 6 thicker than about 60 microns will function well in the current invention, the thicker film will increase the cost of producing the labels described herein. Thus, the PVC or PETG labels of the current invention have a preferable maximum thickness of about 60 microns.

In the process of the present invention, the heat-shrinkable film 6 is used in a cylindrical shape. The dimension of the cylindrical shrinkable film 6 used in the process of the present invention can be selected so as to agree with the dimension of the container main body 2. The height 20 of the cylindrical shrinkable film 6 can be any desired height, but it is preferable in this invention to be larger than the height 22 of the side of the container main body so that the film can overlap 14 a portion of the bottom and top of the container 2.

The circumference $C_1$ of the cylindrical film 6 used in the process of the present invention should be 5%–40% larger than the maximum circumference $C_2$ of the outer side 4 of the container main body. When the circumference $C_1$ of the cylindrical film 6 is too small, it is difficult to carry out the operation of inserting a pre-made cylindrical film around the container 2 main body. When said circumference $C_1$ is too large, the print formed on the inner side 10 of the film 6 is deformed during the heat shrinkage step.

The shrinkage factor of the shrinkable PVC film used in the process of the present invention is 5–10% in the machine direction and 40–60% in the transverse direction. The PVC film has a treating temperature of 80–100° C. If the shrinkage factor is low, the intimate contact between the container main body 2 and the shrinkable film 6 is insufficient and the beauty of the print is impaired. When the factor is too high, the container main body 2 may be deformed.

The shrinkage factor and treating temperature of the PETG film used in the present invention is preferably similar but slightly higher than the shrinkage factor and treating temperature of the PVC film.

While the present invention has been described in connection with a preferred embodiment, it will be apparent to those skilled in the art that many changes and modifications may be made without departing from the true spirit and scope of the invention. Accordingly, it is intended by the appended claims to cover all such changes and modifications as come within the spirit and scope of the invention.

We claim:

1. A process for marketing a container for growing plants comprising:

(a) supplying a container having a heat shrinkable film wrapping heat shrunk directly onto the surface thereof, the heat shrinkable film being selected from the group consisting of polyvinyl chloride and polyethylene terephthalate, glycol modified polymers, the film wrapping having visible display markings thereon and the container having no human-readable visible display markings appearing thereon; the heat-shrunk film wrapping being fixedly attached to the container without applying any adhesive and being removable from the container, (b) displaying the container having the heat shrunk film wrapping thereon exhibiting only the visible markings appearing on the film wrapping; and (c) removing the film wrapping from the container to prevent detection of the visible markings appearing on the wrapping and to reveal only the container having no human-readable visible display markings appearing thereon.

2. The process of claim 1 wherein the container has machine-readable visible display markings appearing thereon with the heat shrunk film wrapping on the container preventing machine detection of the machine-readable visible display markings on the container while the shrink wrap is applied on the container.

3. The process of claim 2 wherein the machine readable display markings are bar codes.

4. The process of claim 3 wherein the machine readable display markings are detectable after the shrink wrap is removed from the surface of the container.

5. The process of claim 1 wherein the visible markings comprise printed visible markings for identifying the purveyor of the container.

6. The process of claim 1 wherein the visible markings comprise printed instructional data.

7. The process of claim 1 wherein the printed heat shrinkable film has a thickness of between about 40 microns and about 70 microns.

* * * * *